US009430899B2

(12) United States Patent
Adiraju et al.

(10) Patent No.: US 9,430,899 B2
(45) Date of Patent: Aug. 30, 2016

(54) CONFIGURING AND CONTROLLING WAGERING GAME PRESENTATIONS

(71) Applicant: WMS Gaming, Inc., Waukegan, IL (US)

(72) Inventors: Srinivyasa M. Adiraju, Vernon Hills, IL (US); Dale R. Buchholz, Palatine, IL (US); Mark C. Pace, Palatine, IL (US); Vikram Swamy, Chicago, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

(21) Appl. No.: 14/668,567

(22) Filed: Mar. 25, 2015

(65) Prior Publication Data

US 2015/0199866 A1 Jul. 16, 2015

Related U.S. Application Data

(63) Continuation of application No. 14/299,917, filed on Jun. 9, 2014, now abandoned, which is a continuation of application No. 13/129,293, filed as application No. PCT/US2009/064280 on Nov. 12, 2009, now Pat. No. 8,771,066.

(60) Provisional application No. 61/114,355, filed on Nov. 13, 2008.

(51) Int. Cl.
*G07F 17/32* (2006.01)

(52) U.S. Cl.
CPC ..... *G07F 17/3211* (2013.01); *G07F 17/32* (2013.01); *G07F 17/323* (2013.01); *G07F 17/3209* (2013.01); *G07F 17/3227* (2013.01)

(58) Field of Classification Search
CPC ..... G07F 17/3211; G07F 17/3209; G07F 17/3227; G07F 17/323
USPC ..... 463/16
See application file for complete search history.

(56) References Cited

U.S. PATENT DOCUMENTS 8,109,829 B1 * 2/2012 Morgan ..... G07F 17/3223 463/20
8,221,218 B2 * 7/2012 Gilliland ..... G07F 17/32 463/16

(Continued)

FOREIGN PATENT DOCUMENTS

JP 2007111209 5/2007
WO 2010056923 5/2010

OTHER PUBLICATIONS

"PCT Application No. PCT/US09/64280 International Preliminary Report on Patentability", May 1, 2012, 9 pages.

(Continued)

*Primary Examiner* — Corbett B Coburn
(74) *Attorney, Agent, or Firm* — DeLizio Law, PLLC

(57) ABSTRACT

A method includes presenting, by at least one processor, a configuration interface to enable creation of a presentation template. The method includes defining a number of presentation areas in the presentation template. The method includes defining a configuration setting for at least a first presentation area of the number of presentation areas, wherein the configuration setting limits a content type that is to be displayed in the first presentation area and defines a display location where the presentation area is positioned. At least one content of a number of content to be displayed in the number of presentation areas comprises wagering game play. The method includes storing, in a machine-readable medium, the presentation template.

24 Claims, 12 Drawing Sheets

(56) References Cited

U.S. PATENT DOCUMENTS

| | | | | |
|---|---|---|---|---|
| 8,251,807 | B2 * | 8/2012 | LeMay | A63F 13/12 463/16 |
| 8,771,066 | B2 | 7/2014 | Adiraju et al. | |
| 2002/0155891 | A1 * | 10/2002 | Okada | G06Q 30/02 463/42 |
| 2004/0048657 | A1 * | 3/2004 | Gauselmann | G07F 17/323 463/25 |
| 2005/0192092 | A1 * | 9/2005 | Breckner | G07F 17/323 463/31 |
| 2006/0287098 | A1 * | 12/2006 | Morrow | G07F 17/32 463/42 |
| 2007/0032288 | A1 * | 2/2007 | Nelson | G07F 17/323 463/16 |
| 2007/0078989 | A1 | 4/2007 | Van Datta | |
| 2007/0129123 | A1 * | 6/2007 | Eryou | A63F 13/12 463/1 |
| 2007/0207855 | A1 * | 9/2007 | Moody | G07F 17/32 463/31 |
| 2008/0004097 | A1 * | 1/2008 | Maya | G07F 17/32 463/16 |
| 2008/0102919 | A1 * | 5/2008 | Rowe | G07F 17/323 463/18 |
| 2008/0132331 | A1 | 6/2008 | Gatto et al. | |
| 2008/0167106 | A1 | 7/2008 | Lutnick et al. | |
| 2009/0291757 | A1 * | 11/2009 | Hilbert | G07F 17/3202 463/31 |
| 2011/0078726 | A1 * | 3/2011 | Rosenberg | G06Q 30/02 725/34 |
| 2011/0300925 | A1 | 12/2011 | Adiraju et al. | |
| 2014/0287834 | A1 | 9/2014 | Adiraju et al. | |

OTHER PUBLICATIONS

"PCT Application No. PCT/US09/64280 International Search Report", Jan. 13, 2010, 9 pages.

"U.S. Appl. No. 13/129,293 Office Action", Dec. 19, 2013, 12 pages.

"U.S. Appl. No. 13/129,293 Office Action", Aug. 9, 2013, 11 pages.

"U.S. Appl. No. 14/299,917 Office Action", Sep. 4, 2014, 6 Pages.

Co-pending U.S. Appl. No. 14/299,917, filed Jun. 10, 2014, 49 pages.

* cited by examiner

CONFIGURING AND CONTROLLING WAGERING GAME PRESENTATIONS

RELATED APPLICATIONS

This application is a Continuation application that claims priority benefit of U.S. application Ser. No. 14/299,917 filed 9 Jun. 2014. The Ser. No. 14/299,917 application claims priority benefit of U.S. application Ser. No. 13/129,293, which is a National Stage Application of PCT/US09/64280 filed 12 Nov. 2009, which claims priority benefit of Provisional U.S. Application No. 61/114,355 filed 13 Nov. 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming, Inc.

TECHNICAL FIELD

Embodiments of the inventive subject matter relate generally to wagering game systems and networks that, more particularly, configure and control wagering game presentations.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Some of those machines, features, and enhancements may include presenting multiple content data ("content") on a single wagering game machine. Developers encounter many challenges programming wagering game machines that can control the presentation of the multiple content, especially considering that there are many factors that can affect content presentation. Therefore, there is a continuing need for wagering game machine manufacturers to continuously develop ways of controlling the presentation of wagering game content.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Casinos, and providers of wagering game entertainment, provide a multitude of wagering games. Those wagering games are created by different wagering game content providers and manufacturers, and are stored on separate gaming machines configured to process and present games from only that provider. When a player wants to play one of the games, the player has to find a specific machine within the casino that contains that wagering game. Some content providers, however, have recognized that a player may want to play more than one specific wagering game, and have thus created wagering game machines that can process and display multiple different wagering games themes. However, controlling the presentation of multiple content on a single display can present certain challenges for game providers and manufacturers. Embodiments of the present invention, however, present ways to control the presentation of multiple content via presentation templates. For example, a wagering game system, according to some embodiments, can present casino operators ("operators") with a configuration tool that can configure presentation templates with fixed presentation areas (e.g., windows, frames, interfaces, etc.) to be used with certain types of content, machines, players, etc. in certain situations. The operators can store the presentation templates on wagering game machines. The wagering game machines can receive content and, based on needs and requirements of the content, determine presentation templates that will present the content in the fixed presentation areas ("presentation areas") according to the needs and requirements of the content. By using presentation templates, an operator can control the appearance of content in a very structured manner, providing a consistent look and feel for content. The fixed structure of the presentation templates relieves the wagering game machine from having to determine how the content should look within a presentation area and allows content from multiple sources to be presented in a way that was preferred or intended by the content provider. Wagering game machines can thus simultaneously process applications in different display areas because the presentation template areas have been pre-configured to function with specific applications, for certain conditions, etc.

Figure 1:
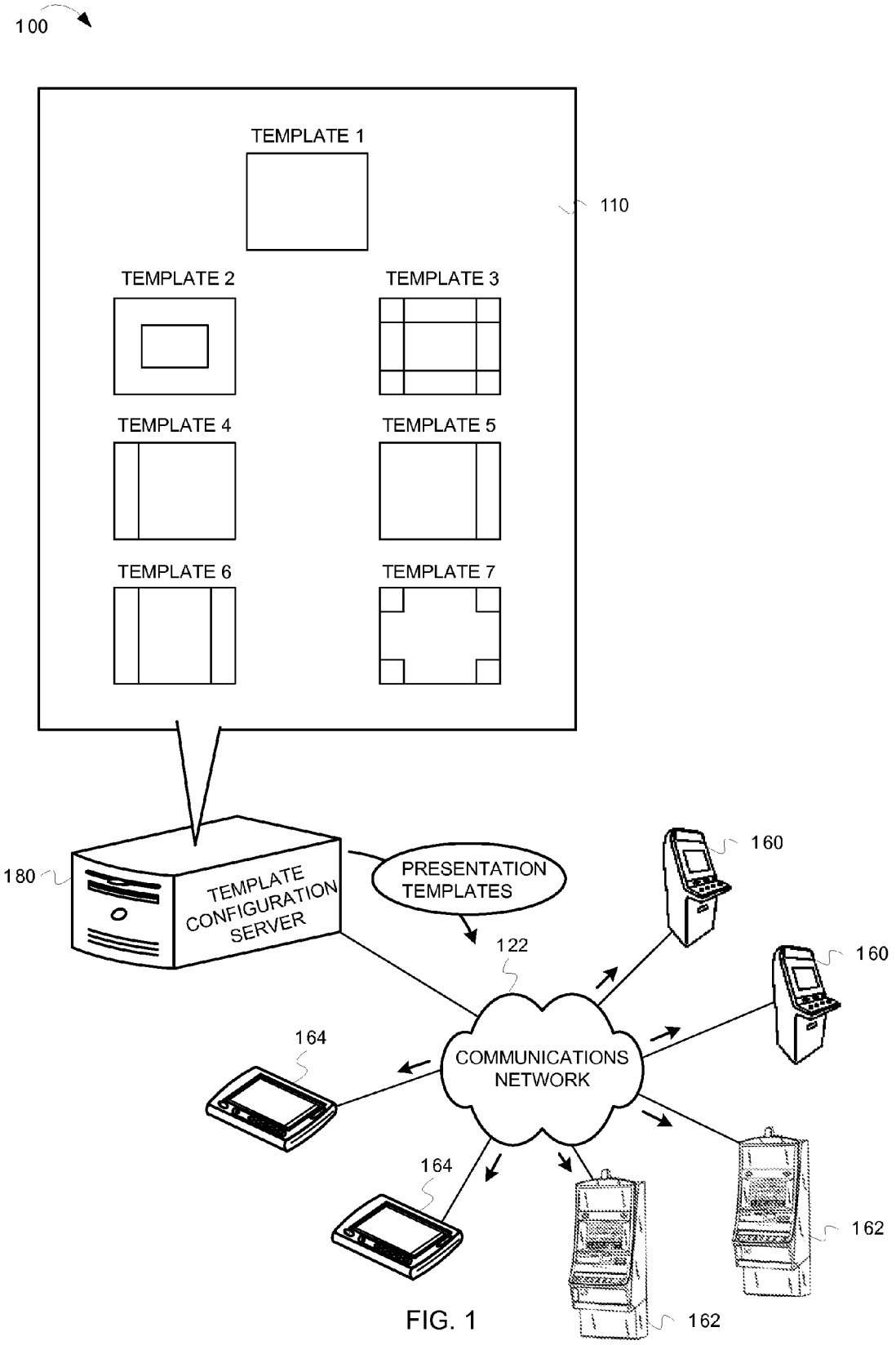
FIG. 1 is an illustration of providing presentation templates to wagering game machines, according to some embodiments.

FIG. 1 is a conceptual diagram that illustrates an example of providing presentation templates to wagering game machines, according to some embodiments. In FIG. 1, a template configuration server 180 stores presentation templates 110, each of which can present content in various presentation areas (see FIG. 5 for a detailed description of some example presentation templates). The template configuration server 180 can be a tool used by an operator to generate, modify and update the presentation templates 110 according to presentation requirements for different content that is displayed at the same time upon displays associated with wagering game machines. The template configuration server 180 can provide some, or all, the presentation templates via a communications network 122 to one or more types of wagering game machines (160, 162, 164) residing within a casino. The wagering game machines 160, 162, 164, use the templates to present content on displays associated with the wagering game machines 160, 162, and 164. Depending on the presentation requirements of the content, the wagering game machines 160, 162, and 164, select a presentation template that can present multiple content data (e.g., communication messages, game assets, advertisements, help screens, minimized game icons, promotional messages, help screens, etc.).

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
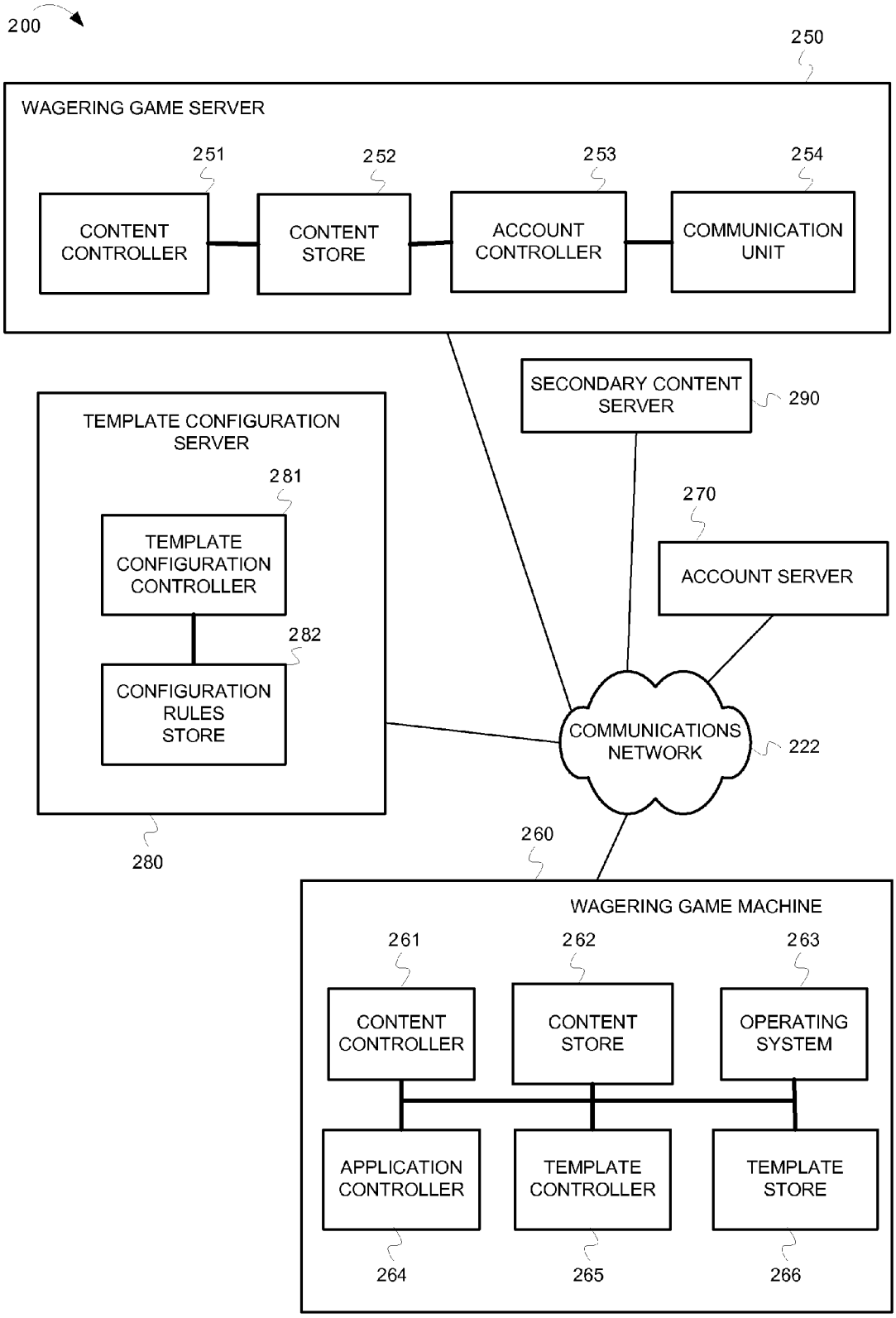
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller configured to control information for a player's account. The account server can also include an account store configured to store information for a player's account.

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks.

The wagering game system architecture 200 can also include the wagering game machine 260 configured to present wagering games and receive and transmit information to configure and control wagering game presentations. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include an operating system 263 configured to control the operation and presentation of system objects and instructions. The wagering game machine 260 can also include an application controller 264 configured to control and support application functionality. The wagering game machine 260 can also include a template controller 265 configured to control the activation, switching, and other uses of presentation templates. The wagering game machine 260 can also include a template store 266 configured to store presentation templates used to present content on the wagering game machine 260.

The wagering game system architecture 200 can also include a secondary content server 290 configured to provide content in addition to content provided by the wagering game server 250 and the wagering game machine 260 (e.g., additional wagering game content, promotions content, advertising content, player tracking content, web content, etc.).

The wagering game system architecture 200 can also include a template configuration server 280 configured to process and control information to configure and control wagering game presentations. The template configuration server 280 can include a template configuration controller 281 configured to control the generation and configuration of templates. The template configuration controller 281 can create templates and configure them with fixed presentation areas having fixed display characteristics, and other properties, for presenting content according to content presentation requirements and other characteristics and constraints related to a wagering game environment, wagering game device types, player characteristics, etc. The template configuration controller 281 can also receive pre-configured templates from game providers and customize them with operator requirements. The template configuration controller 281 can also present filtering and selection controls that an operator can use to select template types and provide the template types to certain wagering game machine types. The template configuration server 280 can also include a configuration rules store 282 configured to store rules concerning presentation requirements, template configurations, template selection requirements, presentation priority, etc.

Each component shown in the wagering game system architecture 200 is shown as a separate and distinct element connected via a communications network 222. However, some functions performed by one component could be performed by other components. For example, the wagering game server 250 or the template configuration server 280 can also be configured to perform functions of the application controller 264, the template controller 265, the template store 266, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250. The wagering game machines described herein (e.g., the wagering game machine 260) can take any suitable form, such as standing floor models, handheld mobile units, bar-top models, workstation-type console models, surface computing machines, etc. Further, the wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as a thin, thick, or intermediate client. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
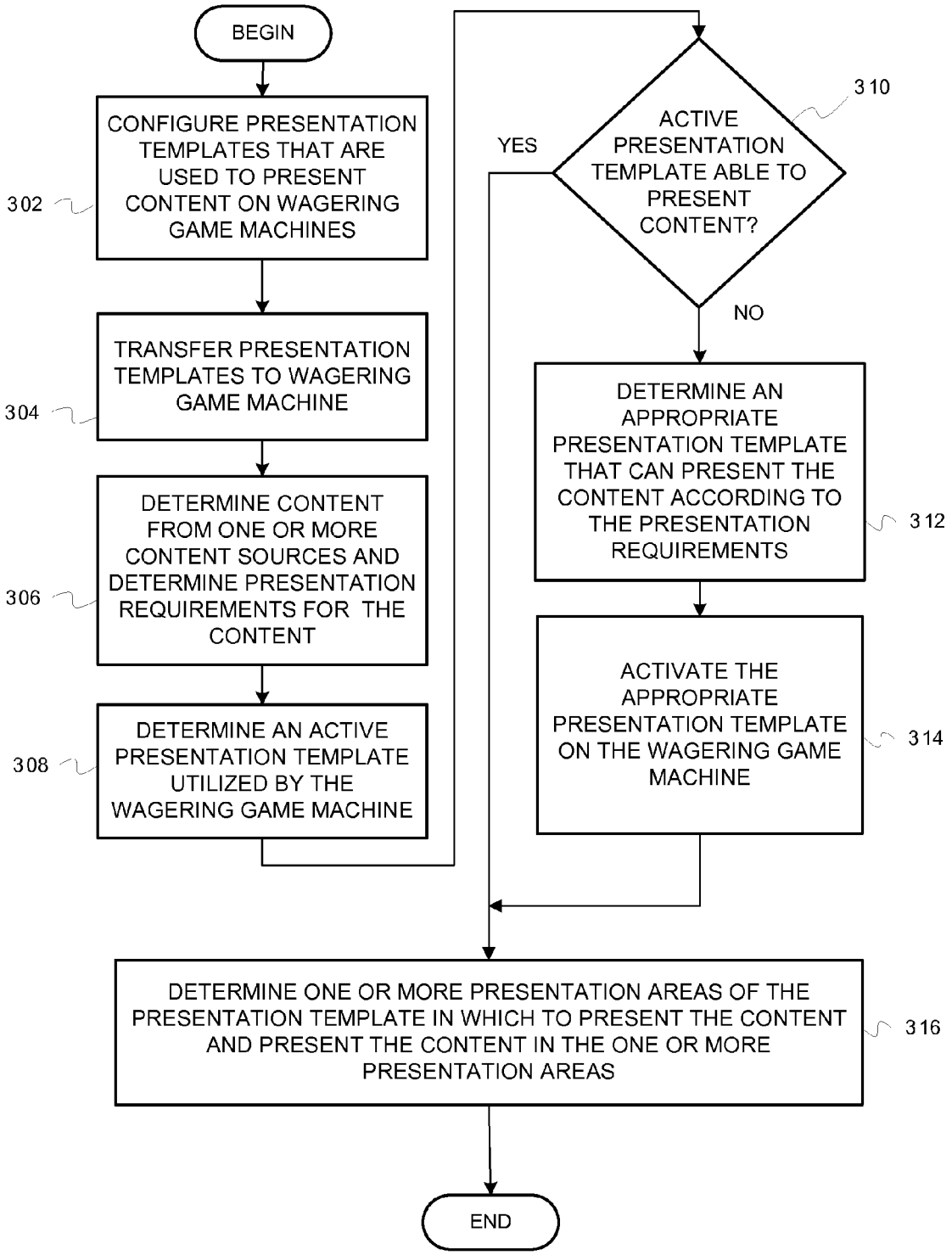
FIG. 3 is a flow diagram 300 illustrating presenting content in presentation templates according to presentation requirements, according to some embodiments.
Figure 4:
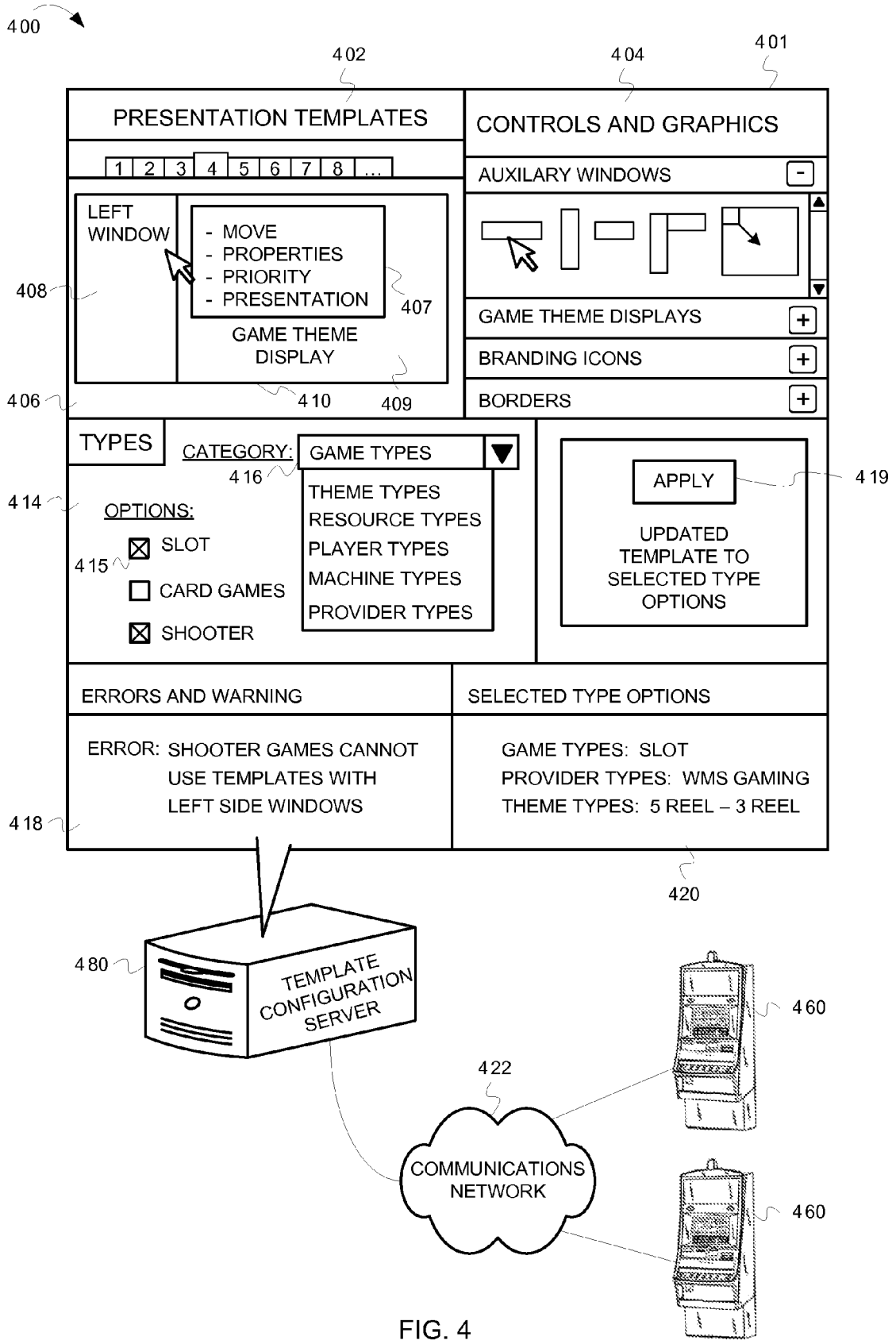
FIG. 4 is an illustration of a wagering game system 400, according to some embodiments.
Figure 5:
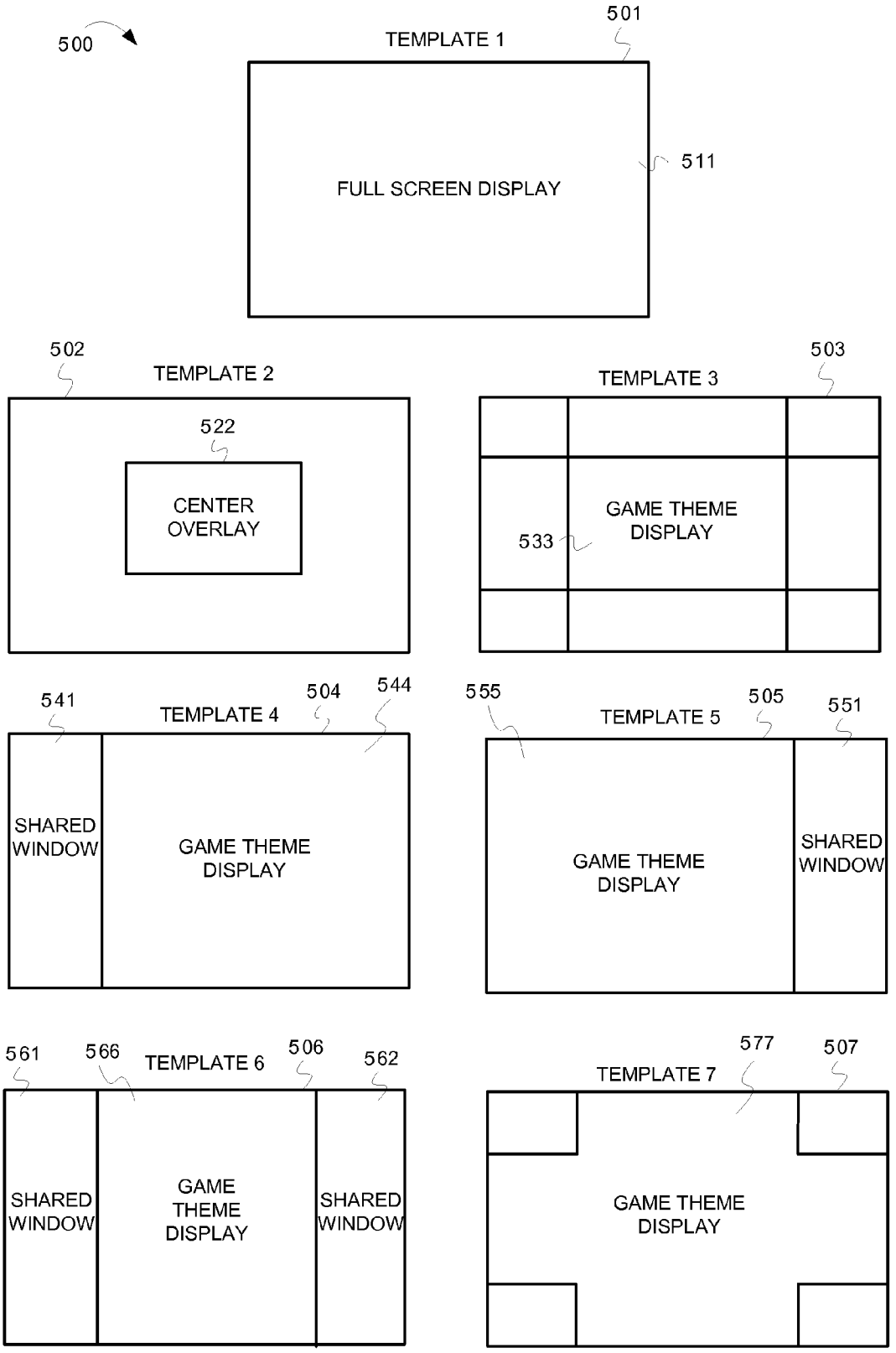
FIG. 5 is an illustration of a presentation templates 500, according to some embodiments.

FIG. 3 is a flow diagram ("flow") 300 illustrating presenting content in presentation templates according to presentation requirements, according to some embodiments. FIGS. 1, 4, 5, 6, and 7 are conceptual diagrams that help illustrate the flow of FIG. 3, according to some embodiments. This description will present FIG. 3 in concert with FIGS. 1, 4, 5, 6 and 7. In FIG. 3, the flow 300 begins at processing block 302, where a wagering game system ("system") configures presentation templates that are used to present content on a wagering game machine. In some embodiments, the system can configure the look and behavior of the presentation templates. The presentation templates can possess fixed presentation areas positioned on the presentation template. The fixed presentation areas can be configured with configuration settings (e.g., properties, characteristics, etc.), that control the look, behavior, sounds, or other presentation characteristics of content. The system can present a configuration tool, as shown in FIG. 4, to create and/or modify presentation templates, with presentation areas, and assign configuration settings to the presentation template and presentation areas of the presentation template. In FIG. 4, a wagering game system ("system") 400 can include a template configuration server 480, which can present a configuration interface 401. The configuration interface 401 can include a template editor 402 in which an operator can create, modify, save, delete, or otherwise configure a presentation template 410. The system 400 can name the presentation template 410 and store the presentation templates in the form of a configuration file that can be provided to (e.g., downloaded to) one or more wagering game machines 460 connected to the template configuration server 480 via a communications network 422. The configuration interface 401 can include objects and controls, such as windows, graphics, borders, branding icons, buttons, etc., that an operator can drag and drop onto the presentation template 410. Some graphics can be specific to an operator. The system 400 can also configure the look and behavior of presentation templates via properties and characteristics 407 associated with a presentation area or any other part of the presentation template 410. The presentation template 410 can include multiple presentation areas, such as a left-hand-side presentation area (e.g., left-side window 408), a main game display presentation area (e.g., game theme display 409), or any other presentation areas available by the configuration tool. The presentation areas may include user interfaces, windows, graphical presentation areas, web interfaces, etc. The properties and characteristics 407 may include configurations related to priority, display, sound, etc. The system 400 can pre-program the properties and characteristics into the presentation template 410. The pre-programmed presentation configurations can interact with content, when provided to one of the wagering game machines 460 and passed into one of the presentation areas of the presentation template 410. Operators can create as many presentation templates as they want to configure. The system can store as many templates as it needs to present content. The system can provide guidelines for limiting the number of presentation areas on a configuration template as based on presentation rules and guidelines for practicality of displaying many windows simultaneously. The presentation template 410 can include various types of presentation areas. The presentation template 410 illustrates two different types, a "main" presentation area (e.g., the game theme display 409) and one or more an auxiliary presentation areas (e.g., the left-side window 408). The main presentation area can be an area of a presentation template within which main game content is displayed (e.g., game graphics, symbols, reels, meters, buttons, etc.). The one or more auxiliary presentation areas, or "windows", can be areas of the presentation template within which additional application content is displayed (e.g., secondary games, advertising, player messages, account data, etc.). The presentation areas can be displayed individually as single "windows" or can be grouped into an area. The presentation areas can include fixed display parameters so that content displayed in a presentation area can display according to a set resolution, size, quality, etc. Each presentation areas can be independent of any other presentation area and can be controlled independently. Some presentation areas can be utilized for displaying minimized icons. Minimized icons can be the result of an application running within a window being minimized. When minimized, the application content within the window can still be operational, just not viewable until the window is maximized. Some presentation areas can be shared or integrated areas for more than one application to use. FIG. 5 illustrates an example of presentation template layouts with main areas (e.g., game theme display areas) and auxiliary areas (e.g., shared windows, overlays, corner windows, etc.). Each of the presentation areas can include characteristics that define the settings for the presentation area. Some examples characteristics may include, but are not limited to, the following:

- Location: a location for a presentation area in relation to a presentation area's border (e.g., X-Y coordinates specifying the location of area on the presentation template)
- Size: a size, in pixels, of the area.
- Scale: a direction in which a presentation area (e.g., the game theme display) scales. The direction can be left to right, right to left, top to bottom, bottom to top, a combination, etc., which can cause the presentation area boundaries to squeeze together.
- Overlay: a layering characteristic whereby a presentation area can overlay on top of another presentation area (e.g., on top of the game theme display).
- Minimization: a minimization characteristic which can suspend the presentation of content in the presentation area and minimize a representation of the content into a minimization area. The minimization feature does not necessarily close the presentation area, which could cause the application running within it to cease operation, but rather it can allow the content to continue to run while the presentation area is no longer visible to the player. The presentation areas may be designed to minimize to an icon that will maximize upon being selected (e.g., touched) by the player or in response to a server-side application message.
- Minimized size: a size of the icon created when the presentation area is instructed to minimize.
- Minimized location: X-Y coordinates specifying the location of the icon to be displayed when the presentation area is minimized.

Figure 8:
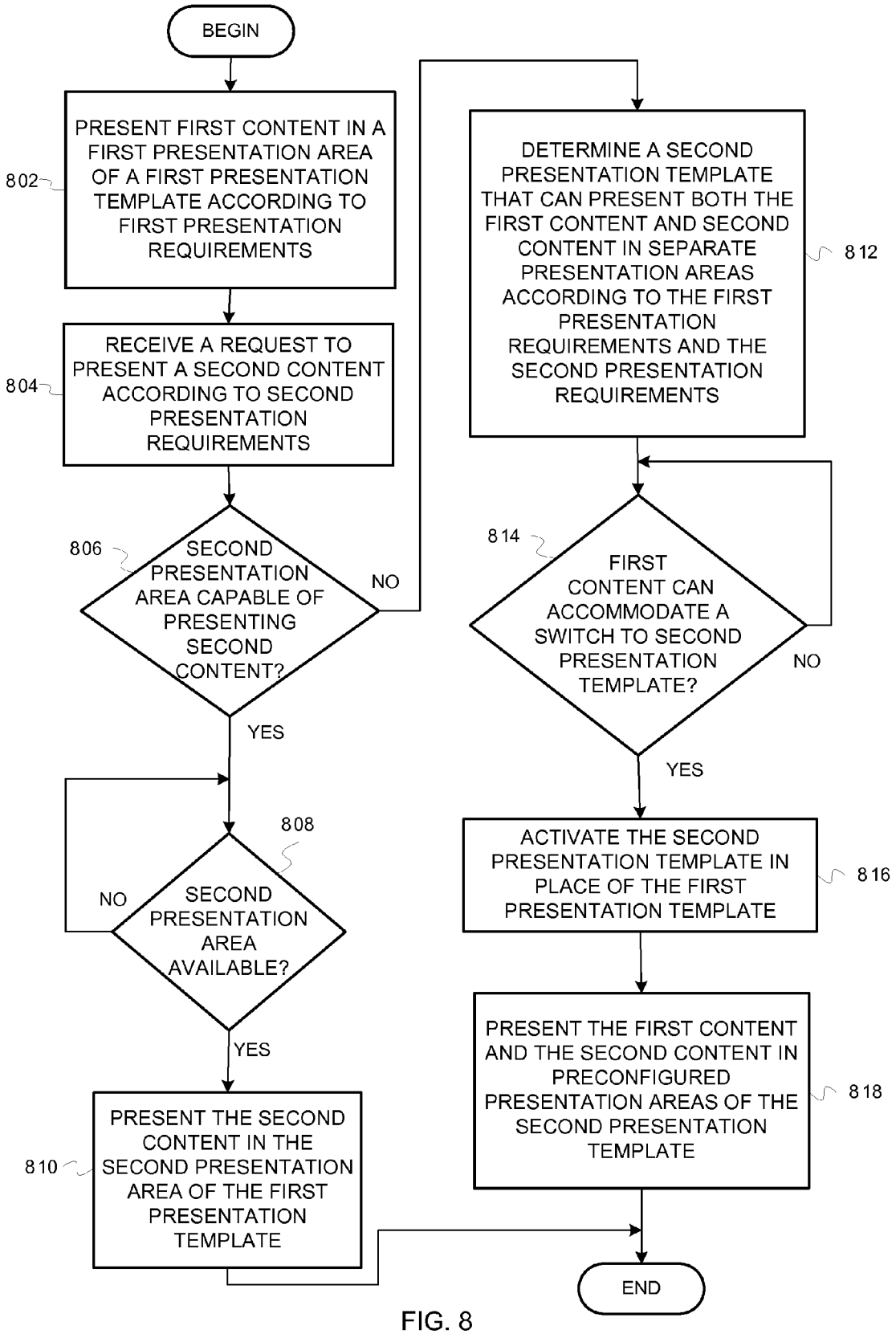
FIG. 8 is a flow diagram 800 illustrating determining and using presentation templates to present multiple content, according to some embodiments.
Figure 9:
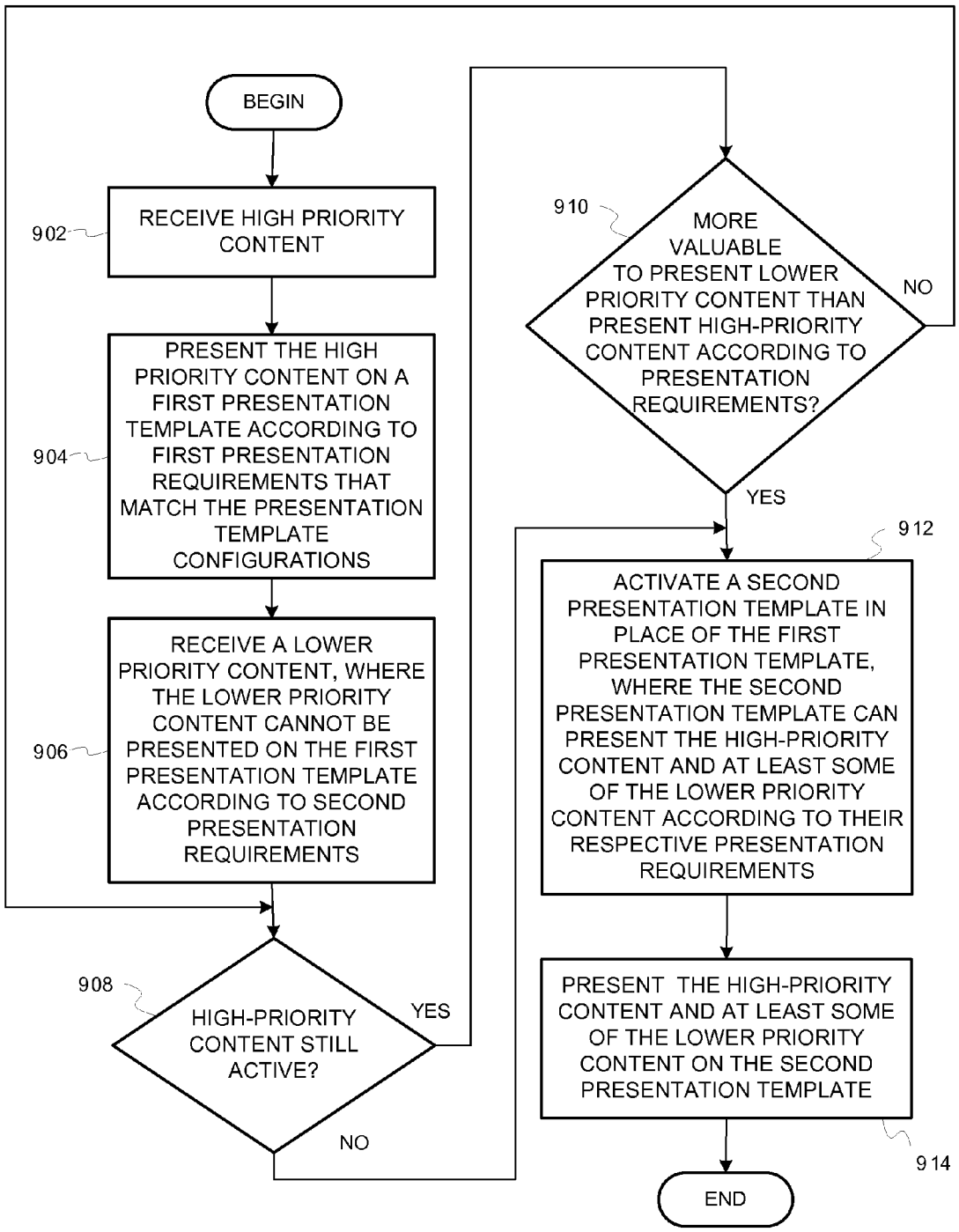
FIG. 9 is a flow diagram 900 illustrating prioritizing the presentation of content on presentation templates, according to some embodiments.

In some embodiments, the presentation templates can be designed so that their layouts compliment each other and can be interchanged to present additional content without unduly affecting content that is already being displayed. For example, a second presentation template 502 includes an overlay presentation area 522 which is compatible with characteristics of (e.g., has common display characteristics with, can fit within the borders of, etc.) (1) a full screen display area 511 of the first presentation template 501, (2) a game theme display area 533 of a third presentation template 503, (3) a right-hand game theme display area 544 of a fourth presentation template 504, (4) a left-hand game theme display area 555 of a fifth presentation template 505, (5) a game theme display area 566 of a sixth presentation template 506, and (6) a game theme display area 577 of a seventh presentation template 507. Further, the fourth presentation template 504 is a mirror image of the fifth presentation template 505. For example, a left-hand shared window 541 of the fourth presentation template 504 has the same set characteristics for displaying content as a right-hand shared window 551 of the fifth presentation template 505. Likewise, the right-hand game theme display area 544 has the same set characteristics for displaying content as the left-hand game theme display area 555. As a result, if the fourth presentation template 504 and the fifth presentation template 505 are interchanged while presenting content within the presentation areas 541, 544, 551, and 555, the display of the content can be interchanged (e.g., from the left-hand shared window 541 to the right-hand shared window 551 and from the right-hand game theme display area 544 to the left-hand game theme display area 555, or vice-versa), without affecting the content resolution, size, etc. of the content. A wagering game machine would not need to determine how to shift the content around the display because the presentation templates would already have the pre-programmed display characteristics and constraints programmed into them. The wagering game machine, and/or its applications, would only need to know that a new template was being interchanged and the wagering game machine, or its applications, would look for a presentation area on the new template that can display the content according to presentation requirements. In the case of conflicts, however, the system can work out conflicts, as illustrated in FIGS. 8 and 9, according to some embodiments. Returning to the discussion of the presentation templates 500, some presentation templates can be partially compatible with other presentation templates. For example, the fourth presentation template 504 and the fifth presentation template 505 can be partially compatible with the sixth presentation template 506 because the left-hand shared window 541 of the fourth presentation template 504 and the right-hand shared window 551 of the fifth presentation template 505 are compatible with the left-hand shared window 561 of the sixth presentation template 506 and with the right-hand shared window 562 of the sixth presentation template 506. However, the right-hand game theme display area 544 and the left-hand game theme display area 555 are not compatible with the game theme display area 566 of the sixth presentation template 506. As a result, the system could interchange the fourth presentation template 504 or the fifth presentation template 505 with the sixth presentation template 506 only by modifying the look of the content displayed within the game theme display areas (e.g., the content as displayed within the right-hand game theme display area 544 or the left-hand game theme display area 555 would have to shrink to fit into the game theme display area 566 of the sixth presentation template 506). As a result, the system may reject an interchange, to preserve the content display, especially during times when game display content within the right-hand game theme display area 544 or the left-hand game theme display area 555, when modifying the display characteristics of the game display content would potentially cause confusion or annoyance to a casino patron.

Returning now to the discussion of FIG. 3, in some embodiments, the system can correlate (e.g., assign, apply, transfer, etc.) presentation templates to wagering game machines based on wagering game machine characteristic types and constraints. Every wagering game machine or group of wagering game machines has it's own unique characteristics, requirements, or constraints based on wagering game machine or group capabilities, functions, locations, audience, etc. The presentation templates can be configured, like a wardrobe, for each wagering game machine or group of wagering game machines. Some presentation templates may possibly apply to multiple characteristics or to multiple types of a single characteristic (e.g., some presentation templates may apply to various machine types). The system can provide controls and settings that an operator can use to select different characteristic types and constraints that a wagering game machine possesses, encounters, or experiences, and apply, or assign, a presentation template to those characteristics. The system can provide (e.g., download) the presentation template to wagering game machines that match some, or all, of the selected characteristic types and/or constraints. For example, in FIG. 4, the template configuration server 480 can present, via the configuration interface 401, a selection panel 414 for selecting characteristic and/or constraint types. A dropdown menu 416 can present various type categories. The selection panel 414 can present type option controls, based on the type category selection, like check boxes 415. An operator can select the available type options by activating the desired check boxes 415. The operator can further select other type categories from the dropdown menu 416 and select additional type options from additional check boxes that would appear showing options for the category type. As the operator select different type options, the configuration interface 401 can present a selection display 420 indicating the various options types that the operator selected. The configuration interface 401 can also include a warning display 418 that indicates whether a selection of an option type would be compatible with features of the highlighted presentation template 410. Some examples of different characteristics and/or constraints related to wagering game machines may include, but not necessarily be limited to, the following:

- Machine type: different wagering game machines can support different sets of presentation templates. Machines types can vary based on characteristics of the machine, such as wagering game machines with reels, wagering game machines with overlapped displays, wagering game machines with props, wagering game machines with different resolutions, wagering game machines with multiple displays, (each display could have its own deck of presentation templates), etc.
- Content Type: games and other content may have constraints (e.g., a full screen display, window of a certain size and shape, text of a certain font, etc).
- Conditions of the wagering game machine: examples of conditions may include the location, the age, the amount of play the machine receives, etc.
- Machine resources: machines may have different processing power, memory size, audio/visual equipment, bandwidth, etc.
- Patron/player type: operators can create presentation templates with layouts that look different depending on, for example, the patron's level. The look and feel of each screen layout can be customized to meet the particular target segment's expectations
- Game themes: different game content may have different graphics, backgrounds, branding, and other themed elements.
- Time of day/year, events, etc.
- Machine or game manufacturers
- Operator constraints: for example, operators may want to apply a certain look and feel.

The flow 300 continues at processing block 304, where the system transfers the presentation templates to a wagering game machine. In some embodiments, the system can determine current versions of presentation templates on the wagering game machine and compare with the current versions with updated versions of presentations templates stored on the template configuration server. The system can download/update presentation templates to the wagering game machine (e.g., via XML messages). The system can update configuration files already existing on the wagering game machine for older versions of presentation templates, download new presentation templates to the wagering game machine that weren't already there, and delete old and outdated presentation templates. The system can also transfer the presentation templates to multiple wagering game machines, based on selections, or filters, for characteristics or constraints. For example, in FIG. 4, the configuration interface 401 can include a submission control, like button 419, which, when selected, can transfer the updated presentation template 410 to all wagering game machines on a casino floor that match the selected type options indicated in the selection display 420. The system can store as many presentation templates on a wagering game machine as the wagering game machine may practically use or need. The system can download and store all of the available presentation templates on a wagering game machine or only those that the wagering game machine will use based on presentation requirements, conditions, characteristics, constraints, etc. The system can activate the presentation templates (i.e., bring them into operation, or focus), when applications (e.g., server-side applications) request to present content on the presentation templates.

Figure 6:
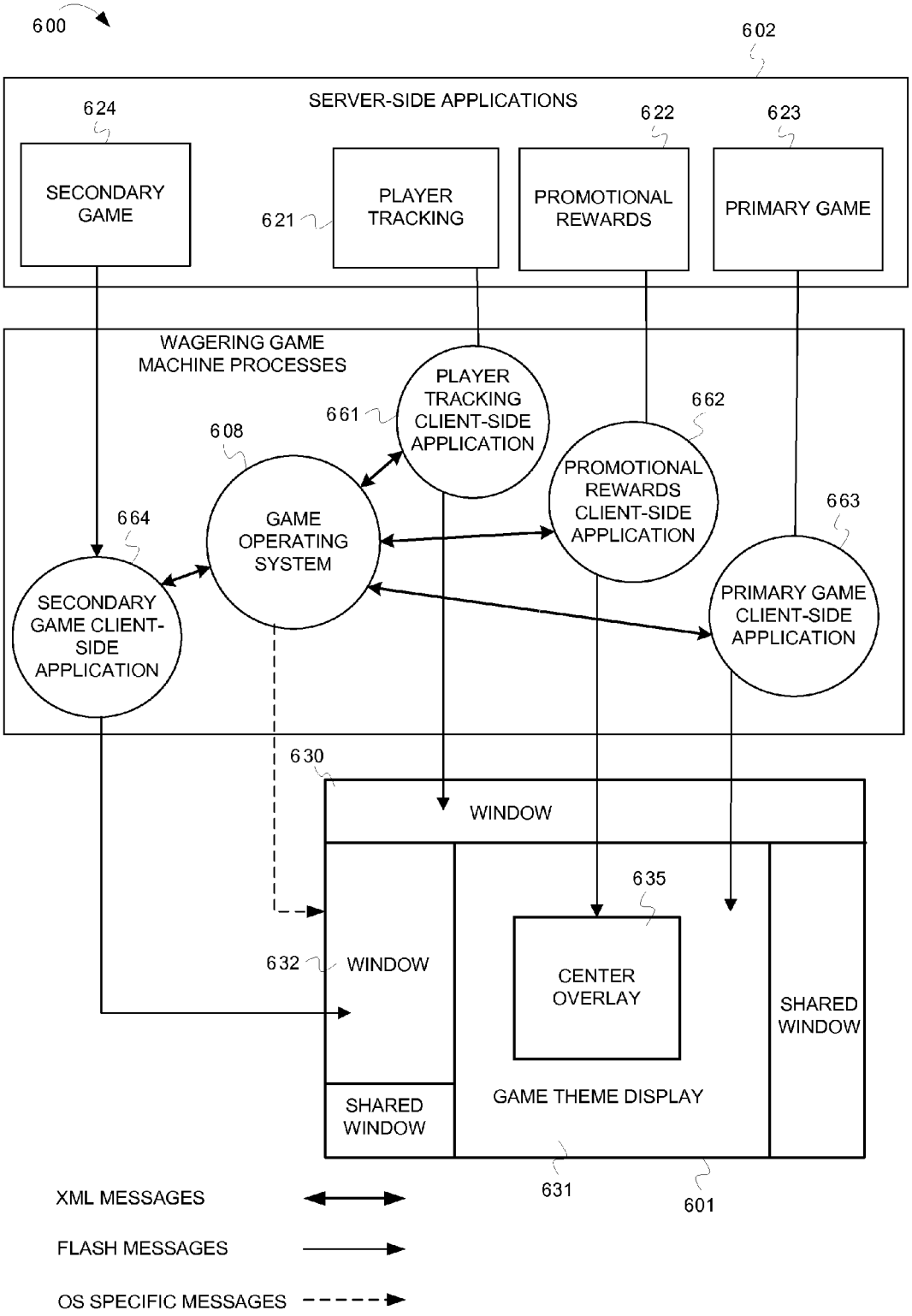
FIG. 6 is an illustration of a wagering game system 600, according to some embodiments.

The flow 300 continues at processing block 306, where the system determines content from one or more content sources and determines presentation requirements for the content. In some embodiments, presentation requirements can be set by a content provider and/or by the casino operator. The requirements can relate to preferred, predetermined configurations, set by the content provider and/or the casino. The configurations can include content display requirements based on selected configuration factors (e.g., characteristics, types, etc.), and/or other needs of the content, such as preferred display sizes and resolutions, preferred presentation area dimensions (e.g., within the main theme display, within a particular sized auxiliary windows, etc.), priority information (e.g., high priority content versus low priority content), etc. In some embodiments, the content can include the presentation requirements (e.g., via attached messages, via metadata, etc.). The content can deliver the presentation requirements when the content is requested or delivered. In other embodiments, system applications and/or services can assign configuration requirements based on presentation rules. The presentation rules can provide display rules, priority rules, and other information related to presentation of specific types of content. In some embodiments, the presentation requirements can be pre-programmed into configurations files associated with the presentation templates. In some embodiments, the system can communicate with server-side and client-side applications to determine content and presentation requirements. The applications can store the content that they will display within each window. One or more servers can provide the content (e.g., provide a URL for the content, offer access to the content for download, respond to requests for the content, etc). Server-side applications can provide the content to a wagering game machine and client-side applications on the wagering game machine can access the content. The wagering game machine can also include applications, modules, software, hardware, etc. that can control the presentation of the content. The system (e.g., applications, wagering game machine, etc.) can provide requests, commands, instructions, messages etc. that control the content presentation (e.g., instructions to lock/unlock the wagering game machine, commands to open windows, commands to load content into windows, commands to close windows, etc.). Server-side application can send the wagering game machine a request to display specific content within a presentation template having a specific layout. The server-side application may specifically indicate presentation areas (e.g., the main theme display, auxiliary windows, etc.) of the presentation template. FIG. 6 illustrates an example wagering game system ("system") 600 that communicates messages between server-side applications 602, client-side applications 661, 662, 663 and 664, a wagering game machine's operating system ("operating system") 608, and a presentation template 601. In FIG. 6 several of the server-side applications 602 communicate data to their respective client-side counterparts 661, 662, 663 and 664 on a wagering game machine. The wagering game machine includes the operating system 608 that can control the use of presentation templates and presentation areas (e.g., see wagering game machine 206 in FIG. 2 for an example architecture). The operating system 608 can control the communications between applications and respond to requests and comments by the applications to present content within one or more presentation areas on the presentation template 601. As an example, in some embodiments, the system 600 can determine that a player logs in to the wagering game machine. A player may insert a player tracking card into a card reader. The card reader reads a magnetic stripe and publishes the encoded information. A server-side, player tracking application 621 and a server-side, promotional rewards application 622, both of which subscribe to the information provided by the card, receive the player's card ID. The player tracking application 621 identifies the player and activates a set of media content designed to welcome the player (e.g., a message indicating the player's status points value and that the player is close to a status upgrade). The promotional rewards application 622 determines that the player has earned a reward (e.g., an offer for free spins). The server-side applications 621 and 622 send messages to the wagering game machine notifying the respective client-side applications (a client-side, player tracking application 661 and a client-side, promotional rewards application 662) that the content is available for download and/or pushes the content to the wagering game machine. The system 600 (e.g., the wagering game machine, the operating system 608, a network service, the client side applications 661 or 662, etc.) determines presentation requirements for the content which indicate that the player tracking content and the promotional content can be presented on the presentation template 601. The player tracking content may indicate that it is to be displayed in a top presentation area 630, or rather in a presentation area that has configuration settings and characteristics that match those of the top presentation area 630. The promotional content may indicate that it is to be displayed in a center overlay presentation area 635. The system 600, therefore, can present the content in the top presentation areas 630 and the center overlay presentation areas 635. At the same time, wagering game applications (e.g., a server-side, primary game application 623 and a server-side, secondary game application 624) can also communicate messages and content to respective client-side game applications (e.g., a client-side, primary game application 663 and a client-side, secondary game application 664). The content for the primary game application 623 can indicate that it is to be presented in a main game theme display area 631. The secondary game application 624 can indicate that it is to be presented in a left-hand window 632. The operating system 608 can provide operating system specific communications to control and coordinate data presented in and/or used to present content within the presentation template 601. Applications can communicate bi-directionally (e.g., Client-side applications can communicate via bi-directional XML messages). Bi-directional communication can be useful so that the system 600 can determine potential conflicts between important, or high priority, applications (e.g., base game applications) and lower priority applications (e.g., secondary applications). Bi-directional communication can also be helpful so that the system 600 can provide cooperation between applications to present their content in ways that compliment other content displayed in neighboring areas. Through the use of a secure socket, wagering game machine specific information can be made accessible to the applications (e.g., ShockWave™ applications) running within presentation areas. However, some applications (e.g., secondary applications, low-priority applications, non-wagering-game applications, etc.) may be restricted from accessing all wagering game machine related information. In this manner, the security and integrity of the wagering game machine can be maintained.

The flow 300 continues at processing block 308, where the system determines an active presentation template utilized by the wagering game machine. The system can load, or activate, a presentation template on a wagering game machine when the wagering game machines powers-up and initializes and at all other times when the wagering game machine is on, for various presentation purposes. For example, after start-up, the system may activate a presentation template that can display attract animations. When a player approaches the wagering game machine and logs in, the system may activate a presentation template that can display logon information. After logging on, the system may activate a presentation template that can display game selection icons, and so forth. Based on triggering activity, the system loads different presentation templates. Whichever presentation template was the last one loaded is the "active" presentation template.

The flow 300 continues at processing block 310, where the system determines whether the content can be presented using the active presentation template according to the presentation requirements. In some embodiments, the content to be displayed in each window can vary. In some cases the content displayed in an auxiliary, or shared, presentation area (e.g., marketing or advertising content, bonus game content, second-chance to win content, mystery bonus content, progressive content, secondary game content, non-game content, etc.) can be different from the content displayed in the main presentation area (e.g., base game content). Consequently, the system can determine the presentation needs of the content and can determine, based on characteristics and configuration information associated with the presentation templates, which presentation areas are best suited for the content that needs to be presented. At the point which the wagering game machine receives the content, the wagering game machine may have a presentation template activated, or loaded. If that "active" presentation template is not capable of presenting the content according the presentation requirements (e.g., the presentation areas are insufficient to present the content properly), then the system can determine that another presentation template would need to be loaded, or activated, before presenting the content. If the content cannot be presented using the active presentation template according to the presentation requirements, then the process continues at processing block 312. Otherwise, the process continues at processing block 316.

The flow 300 continues at processing block 312, where the system determines an appropriate presentation template that can present the content according to the presentation requirements. In some embodiments, the system can determine a presentation template that displays the content according to a preferred configuration. The preferred configuration can represent operator configured, system defined and/or content appropriate display constraints. The presentation template allows the content to be presented as it should, for maximum effect, and avoids presenting content in ways for which it wasn't intended (e.g., avoids forcing content into a static auxiliary window, avoids shrinking or expanding content, avoids presenting content in presentation areas that cannot present specific effects, etc.). In some embodiments, the system can determine the content's needs and select the presentation template that will fit the needs of the content (e.g., a bonus application wants to display an award, and wants to use a full screen). The system then selects an appropriate presentation template from a store of presentation templates on the wagering game machine and/or requests a presentation from a server (e.g., a template configuration server).

The flow 300 continues at processing block 314, where the system activates the appropriate presentation template on the wagering game machine.

Figure 7:
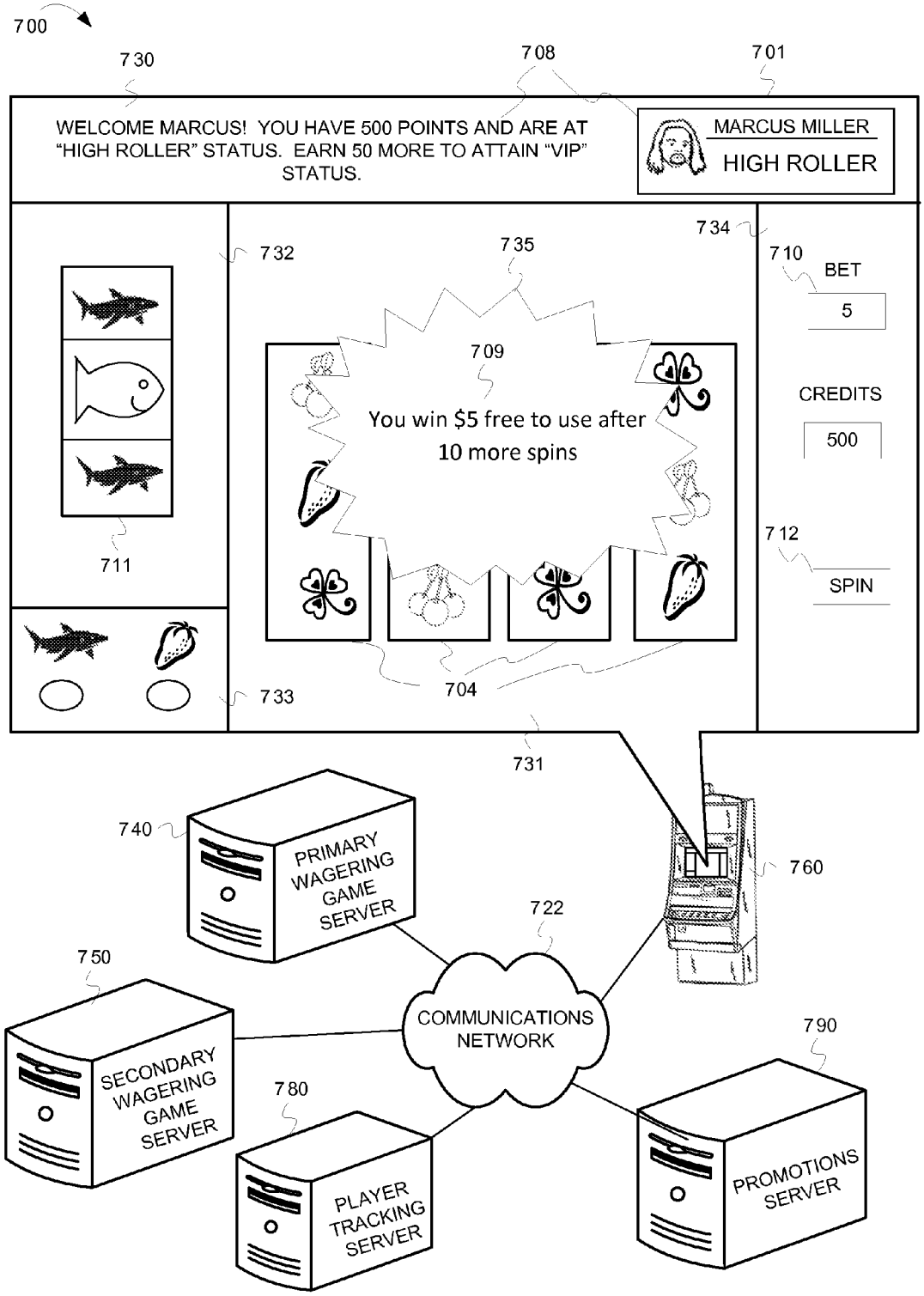
FIG. 7 is an illustration of a wagering game system 700, according to some embodiments.

The flow 300 continues at processing block 316, where the system determines one or more presentation areas of the presentation template in which to present the content and present the content in the one or more presentation areas. In some embodiments, the system can determine presentation requirements of the content; and determine that the one or more presentation areas of the presentation template include configuration settings that match presentation requirements. FIG. 7 illustrates an example of presenting content within the one or more presentation areas of a presentation template. In FIG. 7, a wagering game system ("system") 700, presents content using the presentation template 601 illustrated in FIG. 6. For example, in FIG. 6, the four server-side applications 621, 622, 623 and 624 provide messages indicating that content should be presented in various presentation areas of the template, respectively the top presentation area 630, the center overlay presentation area 635, the main game theme display area 631, and the left-hand window 632. FIG. 7 illustrates the presentation of the content within the presentation areas 630, 631, 635 and 632. In FIG. 7, a wagering game machine 760 receives content from various sources, including a primary wagering game server 740, a secondary wagering game server 750, a player tracking server 780 and a promotions server 790. Each of the servers 740, 750, 780, 790 provides content and requests that the wagering game machine display content within one of the presentation areas 730, 731, 732, 733, 734, and 735. Specifically, the player tracking server 780 requests to present content 708 within a top presentation area 730, the promotions server 790 requests to present content 709 within a center overlay presentation area 735, the primary wagering game server 740 requests to present content 704 within a primary game presentation area 731, and the secondary wagering game server 750 requests to present content 711 within a left-hand side presentation area 732. The servers 740, 750, 780, and 790 can all request to present content within shared presentation areas 734 and 733. For instance, the primary wagering game server 740 and the secondary wagering game server 750 can both present and/or respond to controls 710, 712 within a right-hand-side presentation area 734. The shared, lower-left-hand-side presentation area 733 can present minimized icons for applications, content messages, toggle-buttons, bonus indicators, etc. The wagering game machine 760 presents the content 708, 709, 711, 704 and other items (e.g., the controls 710, 712) within the presentation areas 730, 731, 732, 733, 734, and 735. In some embodiments, the content and other items do not interfere with one another and so the wagering game machine 760 can present the content simultaneously on one presentation template. However, in some embodiments, there may be a conflict of content presentation within presentation areas and/or with presentation templates. FIGS. 8 and 9 below illustrate two examples of prioritizing conflicts of presentation of content on a presentation template according to some embodiments.

FIG. 8 is a flow diagram ("flow") 800 illustrating determining and using presentation templates to present multiple content, according to some embodiments. FIG. 7 is a conceptual diagram that helps illustrate the flow of FIG. 8, according to some embodiments. This description will present FIG. 8 in concert with FIG. 7. In FIG. 8, the flow 800 begins at processing block 802, where a wagering game system ("system") presents first content in a first presentation area of a first presentation template according to first presentation requirements. For example, in FIG. 7, the system 700 presents primary wagering game content from the primary wagering game server 740 in the primary game presentation area 731.

The flow 800 continues at processing block 804, where the system receives a request to present a second content according to second presentation requirements. In some embodiments, the first content and second content can be different types of content. In some embodiments, the first presentation requirements can require that the first content be displayed according to a first display dimension and/or resolution that match configuration settings for the first presentation area. The second presentation requirements can require that the second content be displayed according to a second display dimension and/or resolution that matches, or correlates, to configuration settings for a presentation area other than the first presentation area. For example, in FIG. 7, the secondary wagering game server 750 can request to present a secondary wagering game in a presentation area with a preferred display dimension and resolution.

The flow 800 continues at processing block 806, where the system determines whether at least one other ("second presentation area") of the first presentation template can present the second content according to the second presentation requirements (e.g., the preferred display dimension and resolution) while the first content is presented. For example, in FIG. 7, the system receives content from the secondary wagering game server 750 and refers the presentation requirements (e.g., the preferred display dimensions and resolution) associated with the content. The system can refer to configuration files associated with the active presentation template for the wagering game machine 760. The configuration file indicates the presentation requirements (e.g., lists the display dimensions and resolutions for each presentation area 730, 731, 732, 733, 734, and 735). The system can also refer to the configuration file to determine the name, description, and function for the presentation areas 730, 731, 732, 733, 734, and 735 to determine which ones are configured to present the type of content (e.g., secondary game content) from the secondary wagering game server 750. In some embodiments, the system can determine priority conflicts that may result when presenting content. As stated previously in conjunction to FIG. 5, presentation templates and presentation areas can be designed so that they can be compatible with the other presentation templates and presentation areas. However, sometimes, a presentation area may exist that can present the content, but it is being used. In other embodiments, the presentation template may not have a presentation area that can present the content according to the presentation requirements. If the second presentation area is capable of presenting the second content according to the second requirements, then the process continues at processing block 808. If not, then the process can continue at processing block 812.

The flow 800 continues at processing block 808, where the system determines whether the second presentation area of the first presentation template is available. For example, in FIG. 7, if the content from the secondary wagering game server 750 can be presented in the left-hand side presentation area 732, the system 700 checks to see if there is other content is being actively displayed, meaning that the other content is in the process of being presented. The other content displayed in the left-hand side presentation area 732 may not be able, or willing, to release the left-hand side presentation area 732 (e.g., the other content is receiving a wager, processing game elements, displaying an outcome, etc.). If the second presentation area is available, then the process continues at block 819. If not, then, in some embodiments, the process can return to processing block 808 until the second presentation area is available. In other embodiments, however, the system can determine whether another presentation area (e.g., a third presentation area, a fourth presentation area, etc.) on the first presentation template can present the second content according to the second presentation requirements and whether the other presentation area is available. If there is an additional, available presentation area that can present the second content according to the second presentation requirements, then the process can continue at processing block 810, where the system presents the second content in the other presentation area of the first template. In some embodiments, the second presentation areas (e.g., the left-hand side presentation area 732) is unavailable, but the system determines that the second content is high priority enough to present immediately, without waiting for the other content to release the second presentation area. As a result, the system can minimize the content in the second display area (e.g., minimize the content in the left-hand side presentation area 732 into the shared, lower-left-hand-side presentation area 733) and present a message, icon, or other representation, that the content (or application running the content) is in stasis and is awaiting further action. The system can then present second content in the second presentation area (e.g., in the left-hand side presentation area 732).

The flow 800 continues at processing block 810, where the system presents the second content in the second presentation area of the first presentation template. For example, the wagering game machine 760 presents the content 711 (e.g., secondary wagering game elements) in the left-hand side presentation area 732, which contains presentation configurations that match the presentation requirements for the second content.

The flow 800 continues at processing block 812, where the system determines a second presentation template that can present both the first and a second content in separate presentation areas according to the first presentation requirements and the second presentation requirements. In some embodiments, the system can determine a presentation template that displays the content according to a preferred presentation configuration set by a content provider, according to content display requirements, and/or other needs of the content.

The flow 800 continues at processing block 814, where the system determines whether the first content can accommodate a switch to the second presentation template. In some embodiments, the system can determine whether the content is active (e.g., slot reels are spinning and therefore cannot be stopped to switch templates unless the switch can be done seamlessly). If the first content cannot, or is not willing to, accommodate a switch, according to presentation rules or guidelines for proper display and functionality, then the system can elect to reject the request to switch to a second presentation template. The system can wait until the first content can accommodate the switch (i.e., return to processing block 814) or it can force the switch. In some embodiments, the system can activate the second content (e.g., launch a secondary application) in suspended mode, and present the content when the first content can accommodate the switch. If the system forces the switch before the first content can accommodate the switch, the system can determine options for pausing the first content (e.g., presenting a message to the player that it is pausing the wagering game, then switch the presentation templates). If the first content can accommodate a switch to the second presentation template, then the process continues at processing block 816. If not, then the process can return to processing block 814 until the first content can accommodate the switch to the second presentation template.

The flow 800 continues at processing block 816, where the system activates the second presentation template in place of the first presentation template.

The flow 800 continues at processing block 818, where the system presents the first content and the second content in preconfigured presentation areas of the second presentation template.

FIG. 9 is a flow diagram ("flow") 900 illustrating prioritizing the presentation of content on presentation templates, according to some embodiments. In FIG. 9, the flow 900 begins at processing block 902, where a wagering game system ("system") receives high priority content. High priority content may include content that relates to a high priority, or very important activity, according to presentation and/or priority rules. Examples of high priority content may include wagering games content, and, more particularly, content that relates to wagers, game play elements, and wagering game outcomes. High priority content may be content that should normally not be interrupted in its appearance or function.

The flow 900 continues at processing block 904, where the system presents the high priority content on a first presentation template according to first presentation requirements that match one or more configurations of the first presentation template.

The flow 900 continues at processing block 906, where the system receives a lower priority content, where the lower priority content cannot be presented on the first presentation template according to second presentation requirements.

The flow 900 continues at processing block 908, where the system determines whether the high-priority content is still active. If the high-priority content is still active, then the process continues at block 910. If not, then the process continues at block 912.

The flow 900 continues at processing block 910, where the system determines whether presenting the lower priority content before the high priority content becomes inactive is more valuable than presenting the high-priority content according to its presentation requirements. In some embodiments, the system can supersede, or modify, the priority of the content and can shift the priority of the content (e.g., dynamic determination of the presentation templates based on the number of items in queue). For example, a first presentation template may be displayed that presents the high-priority content. The system wants to present the lower priority content, but requires a second presentation template because the first presentation template does not have an available presentation area that can present the lower-priority content. The system can cause the lower priority content to wait until the high-priority content is displayed. However, the system can instead determine, regardless of the lower-priority content's lower assigned priority, that it can still be valuable to present the lower-priority content even if it means affecting the presentation of the high-priority content. For example, in FIG. 7, the system 700 may present the primary game content on reels 704. The reels 704 may be spinning (a very high priority activity that, according to presentation rules, should normally not be interrupted in its appearance or function). Nevertheless, the promotions server 790 may receive promotional content that indicates that the player will receive a bonus award if the player places wagers to exceed a certain credit value over a number of spins. Thus, the system can determine that although the presentation of the promotional content is a lower priority, according to presentation rules, than presenting the active spinning of the reels 704, the system may determine that the player may want to increase the bet of the current spin, before the reels 704 stop spinning, to count toward the betting requirement indicated in the promotional content. Thus, the system may present the promotional content in the center overlay presentation area 735, even though it may affect the presentation of the reels 704. Alternatively, the system can determine a presentation template that may accommodate both content without significantly affecting the presentation of the reels 704. For example, the game content in the primary game presentation area 731 may indicate, according to presentation requirements, that the reels 704 should be presented at a high resolution. Nevertheless, the system determines that a second presentation template can present the reels 704 in a presentation area, but the reels 704 would be presented on the second presentation template at a lower resolution, contrary to the presentation requirements for the primary game content. The system 700 may, nevertheless, activate a second presentation template that has an available auxiliary presentation area with does not overlay or obstruct the reels 704, present the reels 704 in a presentation areas with a lower resolution (e.g., shrink the size of the reels 704) and also present the promotional content in an auxiliary window while the reels 704 are still spinning. If presenting the lower priority content before the high priority content becomes inactive is more valuable than presenting the high-priority content according to its presentation requirements, then the process continues at block 912. If not, then the process returns to block 908 and waits until the high-priority content is no longer active.

The flow 900 continues at processing block 912, where the system activate s a second presentation template in place of the first presentation template. The second presentation template can present the high-priority content and at least some of the lower priority content according to their respective presentation requirements.

The flow 900 continues at processing block 914, where the system presents the high-priority content and at least some of the lower priority content on the second presentation template.

Additional Example Embodiments

According to some embodiments, a wagering game system ("system") can provide various example devices, operations, etc., to configure and control wagering game presentations. The following non-exhaustive list enumerates some possible embodiments.

In some embodiments, the system can present a small alert (e.g., an icon, an avatar, a customizable ring tone, a highlighted number, etc.) on a mobile wagering game machine to notify a player to take action on an application, a secondary application, etc. (e.g., a notification to take an action with a primary application, a notification to look at a secondary application, etc.). The small alert can be very lightweight and utilize very little processing resources and/or other resources from the mobile wagering game machine. For example, the system can keep a secondary application on standby, in the background, but check periodically for updates and/or present alerts to the user to respond to the secondary application. This can conserve performance for the primary application because the secondary application is on standby and not constantly utilizing processing cycles. However, with small alerts, the system can still notify the player of needs by background applications. The player, however, can respond to those needs at the player's convenience. The small alert can also include a selection for a player to make. For example, the small alert may include a message at the bottom of the wagering game machine display to press a button to activate the content for the secondary application in standby.

Another button can indicate that the message should go away indefinitely or be delayed for a specified period of time.

Additional Example Operating Environments

This section describes example operating environments, systems and networks, and presents structural aspects of some embodiments.

Wagering Game Machine Architecture

Figure 10:
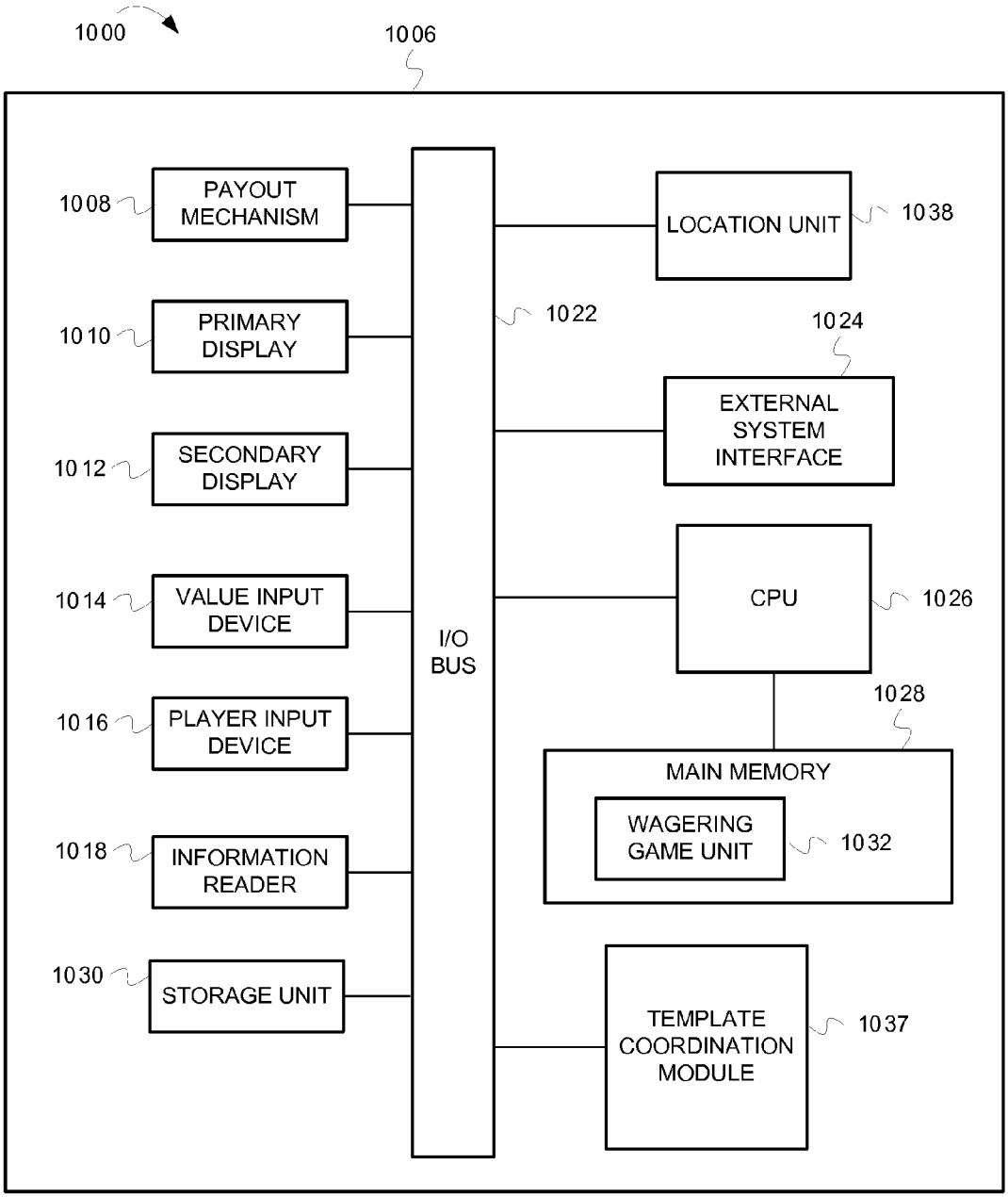
FIG. 10 is an illustration of a wagering game machine architecture 1000, according to some embodiments.

FIG. 10 is a conceptual diagram that illustrates an example of a wagering game machine architecture 1000, according to some embodiments. In FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game unit 1032. In some embodiments, the wagering game unit 1032 can present wagering games, such as video poker, video black jack, video slots, video lottery, reel slots, etc., in whole or part.

The CPU 1026 is also connected to an input/output ("I/O") bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems (e.g., wagering game networks). The external system interface 1024 can include logic for exchanging information over wired and wireless networks (e.g., 802.11g transceiver, Bluetooth transceiver, Ethernet transceiver, etc.)

The I/O bus 1022 is also connected to a location unit 1038. The location unit 1038 can create player information that indicates the wagering game machine's location/movements in a casino. In some embodiments, the location unit 1038 includes a global positioning system (GPS) receiver that can determine the wagering game machine's location using GPS satellites. In other embodiments, the location unit 1038 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 10, in some embodiments, the location unit 1038 is not connected to the I/O bus 1022.

In some embodiments, the wagering game machine 1006 can include additional peripheral devices and/or more than one of each component shown in FIG. 10. For example, in some embodiments, the wagering game machine 1006 can include multiple external system interfaces 1024 and/or multiple CPUs 1026. In some embodiments, any of the components can be integrated or subdivided.

In some embodiments, the wagering game machine 1006 includes a template coordination module 1037. The template coordination module 1037 can process communications, commands, or other information, where the processing can configure and control wagering game presentations.

Furthermore, any component of the wagering game machine 1006 can include hardware, firmware, and/or machine-readable media including instructions for performing the operations described herein.

Mobile Wagering Game Machine

Figure 11:
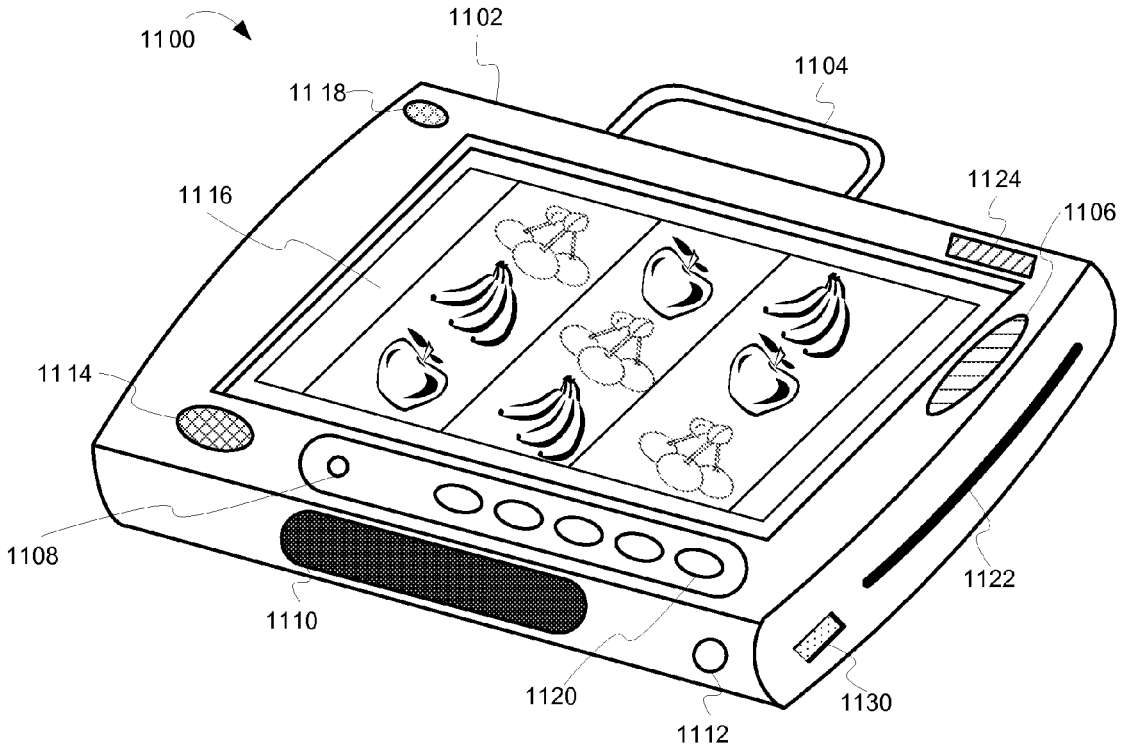
FIG. 11 is an illustration of a mobile wagering game machine 1100, according to some embodiments.

FIG. 11 is a conceptual diagram that illustrates an example of a mobile wagering game machine 1100, according to some embodiments. In FIG. 11, the mobile wagering game machine 1100 includes a housing 1102 for containing internal hardware and/or software such as that described above vis-à-vis FIG. 10. In some embodiments, the housing has a form factor similar to a tablet PC, while other embodiments have different form factors. For example, the mobile wagering game machine 1100 can exhibit smaller form factors, similar to those associated with personal digital assistants. In some embodiments, a handle 1104 is attached to the housing 1102. Additionally, the housing can store a foldout stand 1110, which can hold the mobile wagering game machine 1100 upright or semi-upright on a table or other flat surface.

The mobile wagering game machine 1100 includes several input/output devices. In particular, the mobile wagering game machine 1100 includes buttons 1120, audio jack 1108, speaker 1114, display 1116, biometric device 1106, wireless transmission devices (e.g., wireless communication units 1112 and 1124), microphone 1118, and card reader 1122. Additionally, the mobile wagering game machine can include tilt, orientation, ambient light, or other environmental sensors.

In some embodiments, the mobile wagering game machine 1100 uses the biometric device 1106 for authenticating players, whereas it uses the display 1116 and the speaker 1114 for presenting wagering game results and other information (e.g., credits, progressive jackpots, etc.). The mobile wagering game machine 1100 can also present audio through the audio jack 1108 or through a wireless link such as Bluetooth.

In some embodiments, the wireless communication unit 1112 can include infrared wireless communications technology for receiving wagering game content while docked in a wager gaming station. The wireless communication unit 1124 can include an 802.11G transceiver for connecting to and exchanging information with wireless access points. The wireless communication unit 1124 can include a Bluetooth transceiver for exchanging information with other Bluetooth enabled devices.

In some embodiments, the mobile wagering game machine 1100 is constructed from damage resistant materials, such as polymer plastics. Portions of the mobile wagering game machine 1100 can be constructed from non-porous plastics which exhibit antimicrobial qualities. Also, the mobile wagering game machine 1100 can be liquid resistant for easy cleaning and sanitization.

In some embodiments, the mobile wagering game machine 1100 can also include an input/output ("I/O") port 1130 for connecting directly to another device, such as to a peripheral device, a secondary mobile machine, etc. Furthermore, any component of the mobile wagering game machine 1100 can include hardware, firmware, and/or machine-readable media including instructions for performing the operations described herein.

Wagering Game Machine

Figure 12:
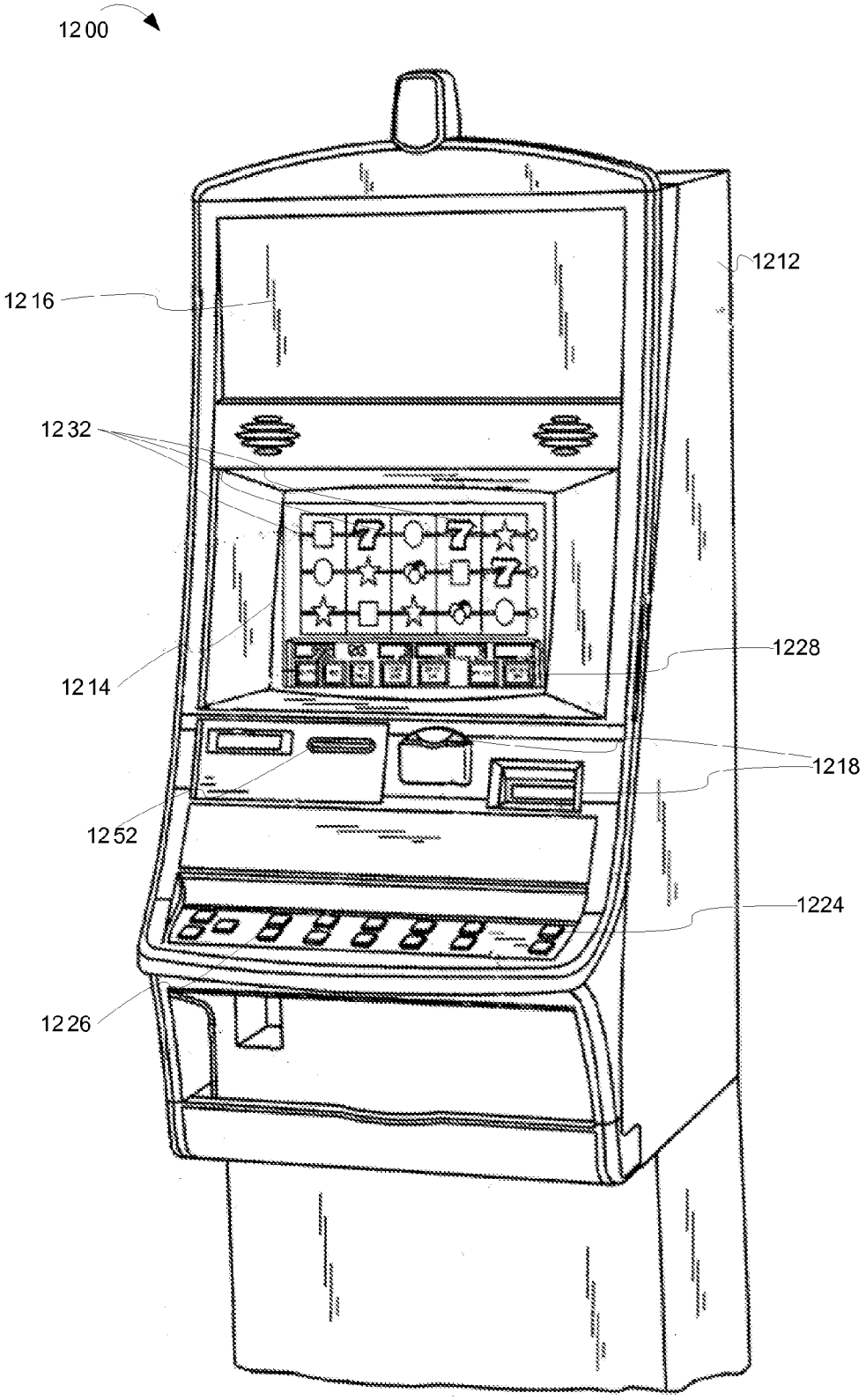
FIG. 12 is an illustration of a wagering game machine 1200, according to some embodiments.

FIG. 12 is a conceptual diagram that illustrates an example of a wagering game machine 1200, according to some embodiments. Referring to FIG. 12, the wagering game machine 1200 can be used in gaming establishments, such as casinos. According to some embodiments, the wagering game machine 1200 can be any type of wagering game machine and can have varying structures and methods of operation. For example, the wagering game machine 1200 can be an electromechanical wagering game machine configured to play mechanical slots, or it can be an electronic wagering game machine configured to play video casino games, such as blackjack, slots, keno, poker, blackjack, roulette, etc.

The wagering game machine 1200 comprises a housing 1212 and includes input devices, including value input devices 1218 and a player input device 1224. For output, the wagering game machine 1200 includes a primary display 1214 for displaying information about a basic wagering game. The primary display 1214 can also display information about a bonus wagering game and a progressive wagering game. The wagering game machine 1200 also includes a secondary display 1216 for displaying wagering game events, wagering game outcomes, and/or signage information. While some components of the wagering game machine 1200 are described herein, numerous other elements can exist and can be used in any number or combination to create varying forms of the wagering game machine 1200.

The value input devices 1218 can take any suitable form and can be located on the front of the housing 1212. The value input devices 1218 can receive currency and/or credits inserted by a player. The value input devices 1218 can include coin acceptors for receiving coin currency and bill acceptors for receiving paper currency. Furthermore, the value input devices 1218 can include ticket readers or barcode scanners for reading information stored on vouchers, cards, or other tangible portable storage devices. The vouchers or cards can authorize access to central accounts, which can transfer money to the wagering game machine 1200.

The player input device 1224 comprises a plurality of push buttons on a button panel 1226 for operating the wagering game machine 1200. In addition, or alternatively, the player input device 1224 can comprise a touch screen 1228 mounted over the primary display 1214 and/or secondary display 1216.

The various components of the wagering game machine 1200 can be connected directly to, or contained within, the housing 1212. Alternatively, some of the wagering game machine's components can be located outside of the housing 1212, while being communicatively coupled with the wagering game machine 1200 using any suitable wired or wireless communication technology.

The operation of the basic wagering game can be displayed to the player on the primary display 1214. The primary display 1214 can also display a bonus game associated with the basic wagering game. The primary display 1214 can include a cathode ray tube (CRT), a high resolution liquid crystal display (LCD), a plasma display, light emitting diodes (LEDs), or any other type of display suitable for use in the wagering game machine 1200. Alternatively, the primary display 1214 can include a number of mechanical reels to display the outcome. In FIG. 12, the wagering game machine 1200 is an "upright" version in which the primary display 1214 is oriented vertically relative to the player. Alternatively, the wagering game machine can be a "slant-top" version in which the primary display 1214 is slanted at about a thirty-degree angle toward the player of the wagering game machine 1200. In yet another embodiment, the wagering game machine 1200 can exhibit any suitable form factor, such as a free standing model, bar top model, mobile handheld model, or workstation console model.

A player begins playing a basic wagering game by making a wager via the value input device 1218. The player can initiate play by using the player input device's buttons or touch screen 1228. The basic game can include arranging a plurality of symbols along a pay line 1232, which indicates one or more outcomes of the basic game. Such outcomes can be randomly selected in response to player input. At least one of the outcomes, which can include any variation or combination of symbols, can trigger a bonus game.

In some embodiments, the wagering game machine 1200 can also include an information reader 1252, which can include a card reader, ticket reader, bar code scanner, RFID transceiver, or computer readable storage medium interface. In some embodiments, the information reader 1252 can be used to award complimentary services, restore game assets, track player habits, etc.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method comprising:

presenting, by at least one processor, a configuration interface to enable creation of a presentation template that controls presentation of wagering game content on a wagering game machine;

receiving, via the configuration interface, a first user input defining presentation areas in the presentation template;

receiving, via the configuration interface, a second user input defining locations for the presentation areas and limiting types of the wagering game content that can be presented in the presentation areas; and creating the presentation template based on the presentation areas, the locations for the presentation areas, and the limiting types of the wagering game content that can be presented in the presentation areas, wherein the wagering game content comprises a wagering game, wherein the wagering game is presented on the wagering game machine in response to input at a player input device of the wagering game machine, wherein an outcome of the wagering game is determined based, at least in part, on one or more random elements to cause an electronic display of the wagering game machine to display the outcome, and wherein a tangible award is credited in response to the outcome meeting a predetermined award criterion.

2. The method of claim 1, wherein a presentation requirement for the wagering game content to be presented in the presentation template includes a restriction on which of the presentation areas is to display the wagering game content.

3. The method of claim 1, wherein the wagering game content to be presented in the presentation template is without a restriction on which of the presentation areas is to display the wagering game content.

4. The method of claim 1, wherein the presentation template is to be selected from among a set of presentation templates for displaying the wagering game content on the electronic display of the wagering game machine, wherein the presentation template is to be selected based on the presentation template satisfying at least one constraint defined for the wagering game machine.

5. The method of claim 4, wherein the presentation template is to be selected based on a presentation template satisfying presentation requirements for the wagering game content to be displayed.

6. The method of claim 4, wherein the at least one constraint defined by the wagering game machine is derived from a location of the wagering game machine within a casino where the wagering game machine is to be played.

7. The method of claim 4, wherein the presentation template is to be selected for presenting the wagering game content on a different wagering game machine that has at least one constraint that is different from at least one other constraint defined by the wagering game machine that is not used in selecting the presentation template.

8. The method of claim 1, wherein the presentation areas comprise a first presentation area and a second presentation area, wherein the second user input limits to a first type of the wagering game content that can be presented in the first presentation area and limits to a second type of the wagering game content that can be presented in the second presentation area, and wherein the first type of the wagering game content is different from the second type of the wagering game content.

9. An apparatus comprising:

one or more processors; and one or more machine readable storable devices including instructions that when executed by the one or more processors, the instructions including, instructions to present a configuration interface to enable creation of a presentation template that controls presentation of wagering game content, instructions to receive, via the configuration interface, user input to define presentation areas in the presentation template, instructions to receive, via the configuration interface, user input to define content types to be displayed in the presentation areas, and to define display locations for the presentation areas, wherein the content types limit types of the wagering game content that can be presented in the presentation areas, and instructions to create the presentation template based on the presentation areas, the display locations for the presentation areas, and the content types to be displayed in the presentation areas, wherein the wagering game content comprises a wagering game, wherein the wagering game is presented on a wagering game machine in response to input at a player input device of the wagering game machine, wherein an outcome of the wagering game is determined based, at least in part, on one or more random elements to cause an electronic display of the wagering game machine to display the outcome, and wherein a tangible award is credited in response to the outcome meeting a predetermined award criterion.

10. The apparatus of claim 9, wherein a presentation requirement for the wagering game content to be presented in the presentation template includes a restriction on which of the presentation areas is to display the wagering game content.

11. The apparatus of claim 9, wherein the wagering game content to be presented in the presentation template is without a restriction on which of the presentation areas is to display the wagering game content.

12. The apparatus of claim 9, wherein the presentation template is to be selected from among a set of presentation templates for displaying the wagering game content on the electronic display of the wagering game machine, wherein the presentation template is to be selected based on the presentation template satisfying at least one constraint defined for the wagering game machine.

13. The apparatus of claim 12, wherein the presentation template is to be selected based on presentation template satisfying presentation requirements for the wagering game content to be displayed.

14. The apparatus of claim 12, wherein the at least one constraint defined by the wagering game machine is derived from a location of the wagering game machine within a casino where the wagering game machine is to be played.

15. The apparatus of claim 12, wherein the presentation template is to be selected for presentation of the wagering game content on a different wagering game machine that has at least one constraint that is different from at least one other constraint defined by the wagering game machine that is not used in selecting the presentation template.

16. The apparatus of claim 9, wherein the presentation areas comprise a first presentation area and a second presentation area, wherein the content types limit a first type of the wagering game content that can be presented in the first presentation area and limit a second type of the wagering game content that can be presented in the second presentation area, and wherein the first type of the wagering game content is different from the second type of the wagering game content.

17. One or more non-transitory machine-readable media having instructions stored thereon, which when executed by a set of one or more processors causes the set of one or more processors to perform operations comprising:

presenting a configuration interface to enable creation of a presentation template that controls presentation of wagering game content on a wagering game machine;

receiving a first user input selecting the presentation template from a plurality of presentation templates, wherein the presentation template satisfies at least one constraint defined for the wagering game machine;

receiving a second user input in the configuration interface;

defining, based on the second user input, presentation areas in the presentation template;

defining, based on the second user input, a first configuration setting for at least a first presentation area of the presentation areas, wherein the first configuration setting limits a first content type to be displayed in the first presentation area and defines a display location of the first presentation area; and creating the presentation template based on the at least one constraint defined for the wagering game machine and the first configuration setting for the first presentation area, wherein the wagering game content comprises a wagering game, wherein the wagering game is presented on the wagering game machine in response to input at a player input device of the wagering game machine, wherein an outcome of the wagering game is determined based, at least in part, on one or more random elements to cause an electronic display of the wagering game machine to display the outcome, and wherein a tangible award is credited in response to the outcome meeting a predetermined award criterion.

18. The one or more non-transitory machine-readable media of claim 17, wherein a presentation requirement for the wagering game content to be presented in the presentation template includes a restriction on which of the presentation areas is to display the wagering game content.

19. The one or more non-transitory machine-readable media of claim 17, wherein the wagering game content to be presented in the presentation template is without a restriction on which of the presentation areas is to display the wagering game content.

20. The one or more non-transitory machine-readable media of claim 17, wherein the presentation template is to be selected based on presentation template satisfying presentation requirements for the wagering game content to be displayed.

21. The one or more non-transitory machine-readable media of claim 17, wherein the presentation template is to be selected for presenting a number of the wagering game content on a different wagering game machine that has at least one constraint that is different from at least one other constraint defined by the wagering game machine that is not used in selecting the presentation template.

22. The one or more non-transitory machine-readable media of claim 17, wherein the at least one constraint defined by the wagering game machine is derived from a location of the wagering game machine within a casino where the wagering game machine is to be played.

23. The one or more non-transitory machine-readable media of claim 17, wherein the first configuration setting comprises at least one of a display resolution and display size.

24. The one or more non-transitory machine-readable media of claim 17, wherein the operations comprise:

defining, based on the second user input, a second configuration setting for at least a second presentation area of the presentation areas, wherein the second configuration setting limits a second content type to be displayed in the second presentation area and defines a display location of the second presentation area, wherein the first content type is different from the second content type and wherein the second configuration setting indicates the first content type is to not be displayed in the second presentation area.

* * * * *